United States Patent [19]

Fife

[11] Patent Number: 4,781,184

[45] Date of Patent: Nov. 1, 1988

[54] CLOSED CIRCUIT BREATHING APPARATUS AND METHOD OF USING SAME

[76] Inventor: William P. Fife, 2350 W. Briargate, Bryan, Tex. 77802

[21] Appl. No.: 896,928

[22] Filed: Aug. 15, 1986

Related U.S. Application Data

[63] Continuation of Ser. No. 570,615, Jan. 13, 1984, abandoned.

[51] Int. Cl.[4] ..... A62B 7/10

[52] U.S. Cl. ..... 128/205.12; 128/205.17; 128/205.24

[58] Field of Search ..... 128/202.26, 204.26, 128/204.28, 205.12, 205.13, 205.17, 205.19, 205.23, 204.25, 202.22, 205.25, 205.27, 205.28, 201.27, 910

[56] References Cited

U.S. PATENT DOCUMENTS

| | | | |
|---|---|---|---|
| 2,348,074 | 5/1944 | Lambertsen | 128/205.17 |
| 2,362,643 | 11/1944 | Lambertsen | 128/205.12 |
| 2,586,670 | 2/1952 | Lambertsen | 128/205.28 |
| 3,402,711 | 9/1968 | Emerson | 128/204.28 |
| 3,575,167 | 4/1971 | Michielsen | 128/205.28 |
| 3,612,048 | 10/1971 | Takaoka | 128/205.28 |
| 3,615,233 | 10/1971 | Doering | 128/205.28 |
| 3,710,583 | 1/1973 | Parker et al. | 128/204.28 |
| 3,738,360 | 6/1973 | Dryden | 128/205.12 |
| 3,814,091 | 6/1974 | Henkin | 155/316 |
| 3,901,230 | 8/1978 | Henkin | 128/910 |
| 3,910,780 | 10/1975 | Henley et al. | 55/158 |
| 3,929,127 | 12/1975 | Paul | 128/205.12 |
| 4,163,448 | 8/1979 | Grouard | 128/205.12 |
| 4,195,627 | 4/1980 | Haertle | 128/202.26 |
| 4,233,971 | 11/1980 | Gronau et al. | 128/202.26 |
| 4,266,539 | 5/1981 | Parker et al. | 128/205.12 |
| 4,302,153 | 12/1982 | Wilson et al. | 128/202.26 |
| 4,360,018 | 11/1982 | Choksi | 128/205.12 |
| 4,453,543 | 6/1984 | Kohnke et al. | 128/205.17 |

FOREIGN PATENT DOCUMENTS

| | | | |
|---|---|---|---|
| 173126 | 1/1964 | U.S.S.R. | 128/205.28 |

*Primary Examiner*—Edward M. Coven
*Assistant Examiner*—K. M. Reichle
*Attorney, Agent, or Firm*—Pravel, Gambrell, Hewitt, Kimball & Krieger

[57] ABSTRACT

A breathing apparatus provides a closed circuit which is capable of delivering substantially pure oxygen and removing carbon dioxide exhaled by a subject. The apparatus has low breathing resistance, the ability to provide intermittent positive pressure breathing and can be completely and efficiently purged of inert gases and other fluid impurities which are initially in the apparatus or exhaled by the subject. A carbon dioxide removal system in the apparatus prevents channeling of exhaled gases through scrubber material, thereby insuring efficient carbon dioxide removal. The condition of the carbon dioxide absorption material can be determined by visual inspection by an attendant while the subject is connected to the apparatus.

13 Claims, 1 Drawing Sheet

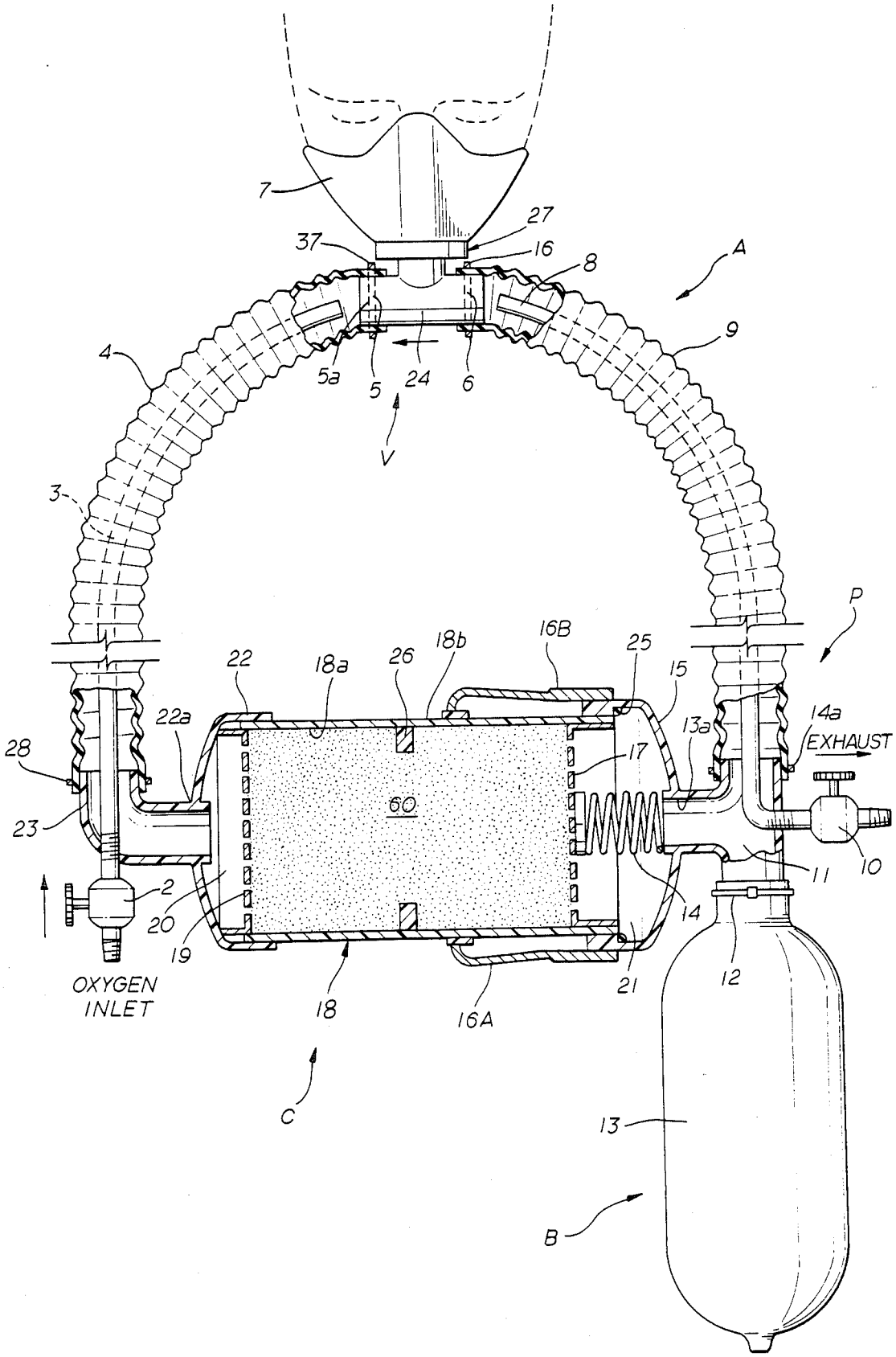
7
27
37
16
8
A
9
4
5a
5
24
6
V
3
P
16B
25
22
18a
26
18b
15
22a
13a
14a
EXHAUST
28
17
60
23
10
11
2
14
20
19
12
OXYGEN
INLET
18
16A
21
C
13
B

CLOSED CIRCUIT BREATHING APPARATUS AND METHOD OF USING SAME

This is a continuation of application Ser. No. 570,615 filed Jan. 13, 1984 now abandoned.

FIELD OF THE INVENTION

This invention relates to apparatus which permit breathing substantially pure oxygen under many conditions, and more particularly to a breathing apparatus capable of recycling exhaled breathing gas through a carbon dioxide remover and adding oxygen when needed to replace the oxygen metabolized by the body.

BACKGROUND OF THE INVENTION

There are a number of apparatus which permit more-or-less pure oxygen to be breathed. The simplest of these devices employs a source of oxygen, and a method of delivering it to the lungs by a connection element such as a mask or mouth piece. The exhaled gas is exhausted into the air and thus lost for further use. These systems, called open circuit systems, do not conserve oxygen. This may be important since when breathing pure oxygen, only about 2.5% of the oxygen inspired is utilized by the body. The rest of the oxygen is exhaled with each breath and wasted. The exhaled gas from such systems contains about 97.5% oxygen. If this gas is allowed to accumulate in a closed room or chamber it may become a fire or explosion hazard.

It is possible to partly overcome the shortcomings of the once through systems by the use of a more complicated closed or semi-closed breathing system. In a semi-closed system part of the expired gas is retained in the system while the rest is exhausted from the system. The exhaled carbon dioxide is removed from the gas remaining in the system by a chemical carbon dioxide absorber, and the gas returned to the inhalation side of the breathing apparatus. Fresh gas is injected into the system to replace the volume eliminated with each breath. In contrast to the semi-closed system, a closed system retains all of the exhaled gas and passes it through the carbon dioxide absorber to remove the exhaled carbon dioxide.

While prior closed-circuit breathing apparatus provide for a more efficient use of the available oxygen supply than do the open-circuit or semi-closed systems, existing closed systems contain several weaknesses. Few, if any, closed systems use a tightly fitting, leak-proof connection element such as a mask. As a result, they do not deliver substantially pure oxygen to the subject. None of the closed systems can be purged efficiently and economically. In most instances, the present closed systems have certain dead spaces which do not permit the entire volume to be purged. Because of design limitations, even those without dead spaces require the use of an excessive amount of oxygen to completely exchange all of the gas in the system. The present rebreather units may lack a carbon dioxide scrubber which can be visually inspected while in operation to determine when the absorption granules have been exhausted and must be replaced.

In certain medical applications it is not necessary, or even desirable, for the subject to breathe substantially pure oxygen. There are other situations in which it is essential for the subject to breathe substantially pure oxygen, and that only substantially pure oxygen is being delivered to the subject. One such instance is when the subject is a diver being treated for decompression sickness. Another is when the subject is being treated in a hyperbaric chamber for such problems as carbon monoxide poisoning, gas gangrene, and many other diseases. During these treatments, it is important that the subject not be exposed to elevated levels of carbon dioxide.

One additional problem which must be recognized is that in some cases an injured individual must be evacuated from a remote area, and may be many hours away from a medical facility. In many such instances, the uninterrupted administration of substantially pure oxygen is the preferred treatment. Thus, it is important that the breathing apparatus be able to deliver substantially pure oxygen at all times, and that it use oxygen as efficiently as possible. The breathing apparatus must be rugged, reliable, and simply constructed since it will often be used under primitive field conditions.

It should be noted that the use of pure oxygen is important and even essential to life in many types of medical problems. Some of these needs are found in diving or caisson accidents, heart attacks, asphyxiation, gas gangrene, carbon monoxide poisoning, near drowning, smoke inhalation, and many others. Most, of the prior breathing devices including those described in U.S. Pat. Nos. 575,167; 4,163,488 and 3,929,127 have tried to meet various of these needs. However, all of them fail to solve some of the essential requirements, such as the need for very efficient use of the available sources of oxygen, and a completely reliable delivery of substantially pure oxygen without the presence of carbon dioxide.

SUMMARY OF THE INVENTION

A closed circuit breathing apparatus is provided for connection to an oxygen supply for providing substantially pure oxygen to a subject. A connection element for the subject provides the oxygen to the subject for breathing and an exit for exhaled gases. A non-return valve assembly including an inhalation valve, an inhalation conduit connected to the inhalation valve, an exhalation valve and an exhalation conduit connected to the exhalation valve is connected to the connecting element. A carbon dioxide absorption system is in fluid communication with the inhalation and exhalation conduits. An expansible breathing bag is in flow communication with the non-return valve assembly. Purge lines extend into the inhalation and exhalation conduits for introducing the oxygen and purging gases initially in the apparatus or exhaled by the subject from the apparatus.

The present invention provides a compact, light weight, efficient, closed-circuit breathing system which provides delivery of substantially pure oxygen and the substantially complete removal of carbon dioxide. It has low breathing resistance, the ability to provide intermittent positive pressure breathing, and can be completely, efficiently and quickly purged of gases which are exhaled from the body or initially present in the apparatus. It is of rugged, simple construction and can be used under primitive field conditions where many other more delicate apparatus may be impractical.

The closed-circuit system of the present invention greatly extends the use time from a single source of oxygen over prior apparatus. Since the subject using the system of the present invention exhales gases into the system, these gases accumulate and dilute the oxygen. Thus, this invention provides for these gases to be purged from the system periodically with the expenditure of only a small amount of oxygen. Further, since the exhausted gas contains some oxygen, the system permits the exhausted gas to be removed from the chamber or room and avoids fire hazards.

The invention provides the capability to administer intermittent positive pressure breathing in an efficient manner with little effort by the use of the breathing bag. This becomes essential in many instances in which a subject is unable to breathe spontaneously.

The invention also includes an efficient carbon dioxide scrubbing system. This is assured in three ways. Firstly, the dimensions of the scrubber canister are based on research which has determined the most efficient lenth-to-cross sectional area and configuration for such a device. Secondly, the positive pressure on the baffle plate holding the scrubber material maintains the scrubber material in a compact condition, thus preventing the granules from becoming loose due to shrinkage or settling. Thirdly, since the resistance to gas flow is less along the wall of the canister, gas tends to channel and seek the walls. The presence of a baffle forces this gas back into the middle of the scrubber material. The firm packing of the granules and the baffle avoid channelling of the gas around the absorber material and make it possible for the apparatus to be used in any position. Finally, the design of the canister permits rapid replacement of the carbon dioxide scrubber material.

The apparatus of the present invention can be used without modification either at sea level, at high altitude, or under increased ambient pressure such as in a hyperbaric chamber used for treatment of divers or other medical diseases. With the addition of a water trap on the exhaust side of the system and a state-of-the-art mouthpiece which can be opened or closed, this apparatus may be used under water.

The invention together with further objects and advantages thereof will best be understood by reference to the following description of preferred embodiments taken in conjunction with the accompanying drawing.

BRIEF DESCRIPTION OF THE DRAWING

The single FIGURE is an elevation view, taken partly in cross-section, of a closed-circuit breathing system embodying the present invention.

DETAILED DESCRIPTION OF PREFERRED EMBODIMENT

Referring to FIG. 1, a closed-circuit breathing apparatus A of the present invention is shown. The apparatus A includes a connection element 7 secured to a subject user or patient, which is further connected to a non-return valve assembly V by a clamp 27. The connection element 7 may be a mask, covering a subject's nose and mouth, or merely a mouthpiece and any of several-types may be employed without departing from the spirit of the present invention. The non-return valve assembly V includes a non-return valve 24, an inhalation hose 9, an exhalation hose 4, an elbow 23, and a T-connector 11. The apparatus A also includes a purge system P, a carbon dioxide absorption means C and a breathing bag B.

The inhalation hose 9 is fixed to the non-return valve 24 by a clamp 16, and to a high-impact resistant plastic T connector 11 by a clamp 14*a*. Although plastic is preferred for connector 11, other materials may also be used. A positive pressure breathing bag 13 is composed of a resilient material, for example silicone or neoprene rubber, and is fixed to the T-connector 11 by a clamp 12. The location of valve 10 and bag 13 on connector 11 may be any one of several in addition that shown. The T-connector 11 is also connected to a cap 15 at an outlet port 13*a* and is made, for example, from a high-impact resistant plastic material. The cap 15 is a removable end of a tubular canister 18 containing a carbon dioxide scrubber composition 60. Suitable compositions, for example are those sold as Soda-Sorb by the Dewy-Almy Company or its equivalent. Lithium hydroxide can also be used. The canister 18 is made of a high-impact clear synthetic resin or an equivalent material with a removable rubber or neoprene baffle 26. The canister 18 is preferably of a size greater than the resting tidal volume of air for a subject. Further, based on experimental data, an optimum length-to-diameter ratio of approximately three to one increases the efficiency of scrubber operation. A neoprene O ring 25 is positioned in cap 15 to provide an air tight seal with the body 18*b* of the canister 18. The cap 15 is held to the canister body by spring-loaded clamps 16*a* and 16*b*.

A spring 14 of stainless steel or other suitable material is fixedly mounted to the T-connector 11, and also to a movable perforated stainless steel disc 17 which presses the scrubber material 60 against a fixed, perforated disc plate 19 and firmly secures the material against loosening. A baffle 26 in the form of an annular disc is loosely and removably mounted in the scrubber material 60 abutting the inner wall 18*a* of canister 18. The removable baffle 26 prevents gas moving through canister 18 from taking the pathway of least resistance along the wall 18*a* of the canister 18. As the gas reaches the baffle 26, it is directed back to the middle of the column of scrubber material 60, thus increasing the efficiency of the scrubber system. The cavity 21 defined by cap 15 and canister 18 within which spring 14 is disposed makes it possible for gas to pass through the entire cross sectional area of disc 17. An end cap 22, preferably of a high impact synthetic resin, forms a cavity 20 which allows breathing gas to pass through plate 19 across its entire surface. The cap 22 is permanently sealed to canister body 18, and has an inlet port 22*a* connected to an elbow 23. The exhalation breathing hose 4 is fixed to elbow 23 by a removable clamp 28, and to the non-return valve 24 by removable clamp 37.

The apparatus A includes an oxygen supply from a standard high pressure oxygen cylinder of a size based on projected usage needs. The oxygen cylinder is connected to an oxygen supply inlet valve 2 which is permanently installed in the elbow 23. In practice, oxygen is supplied through a pressure regulator, as is common to medical oxygen delivery systems. It is desirable, but not essential, that the oxygen pressure at inlet valve 2 be in the range of approximately two to ten pounds per square inch. It also is desirable, but not essential, that the regulator be equipped with a suitable oxygen flow meter operating in the range of zero to ten liters per minute. Flexible inlet supply tubing 3 is attached to valve 2, and extends up the inside of the exhalation hose 4 to a point near, but not touching, a one-way exhalation valve 5 of the non-return valve 24.

An exhaust or outlet purge valve 10 is fixedly mounted in the T-connector 11. The outlet purge valve 10 may be connected via an outlet tube or hose to a location external to that where the apparatus is being used in order to avoid any fire hazards. A flexible tubing member 8 is securely attached to the outlet purge valve 10 and extends inside of the inhalation hose 9 to a point near, but not touching, a one-way inhalation valve 6 in the non-return valve 24.

The operation of the apparatus, as shown in FIG. 1, is initiated when oxygen supply inlet valve 2 is opened, immediately following which the connection element 7 is secured to the subject. Outlet purge valve 10 is temporarily closed. Oxygen is thus supplied to the subject and at the same time begins to fill breathing bag 13. When bag 13 is approximately half full, outlet purge valve 10 is opened and air in the system is exhausted as oxygen continues to enter through inlet 2. As an alternate method, if there is no danger of accumulating oxygen in the room, gas may be purged from the system by releasing the pressure on the mask straps, thus allowing gas to escape around the mask. It is to be noted that as oxygen enters the system it is carried by tubing 3 to an outer face 5*a* of one-way exhalation valve 5. From there, the oxygen flows in a more-or-less laminar manner back down the exhalation hose 4, through the carbon dioxide scrubber canister 18, exiting the scrubber via T-connector 11, and flowing up inhalation hose 9. Upon arriving at the one-way inhalation valve 6, the oxygen enters tubing 8 and proceeds retrograde to outlet purge valve 10, exiting the system. The air originally in breathing bag 13 can be purged by manually collapsing bag 13 a suitable number of times, such as twice. In this manner, bag 13 once purged can be filled with pure oxygen.

When the breathing apparatus A is purged of air, the valves 2 and 10 are closed and the apparatus A is completely sealed and isolated from ambient air. Upon inhalation by the subject, valve 6 is drawn open. Oxygen is drawn from bag 13, flowing up inhalation hose 9 and entering the connection element through one-way inhalation valve 6 and thence to the lungs of the subject. Upon exhalation, oxygen, now containing carbon dioxide and other gases and vapors exhaled by the subject reenters the non-return valve 24, closing one-way inhalation valve 6 and opening one-way exhalation valve 5. The exhaled gas then exits non-return valve 24 via exhalation valve 5, flowing down through exhalation hose 4, elbow 23 into canister 18. While in canister 18, the carbon dioxide scrubber material 60 chemically removes the carbon dioxide from the exhaled gases and purifying the oxygen present in the system. Thereafter, the purified oxygen flows into the bag 13.

It can be seen that with the present invention, all of the oxygen not utilized by the subject during a breath is returned to the bag 13 cleansed of carbon dioxide, and can thus be inspired again. The result is that virtually all of the available oxygen will be utilized by the body. The efficiency of this $CO_2$ removal system is increased for two reasons. The first is that the volume of the scrubber canister 18 ordinarily is greater than the resting tidal volume of virtually all subjects. As a result, the exhaled gas remains in the canister while the subject inspires the next breath. While this pause is not usually necessary, it may become important if the scrubber material must be used for an unusually extended period of time without change.

The second reason for the increase in efficiency is that baffle 26 prevents the gas from passing through the scrubber canister 18 in a manner channeling along its walls. The baffle 26 redirects the flow to the center of the granules 60 which otherwise would not come into contact with much of the carbon dioxide.

Since the scrubber material 60 changes color when it no longer is able to absorb carbon dioxide, this color change can be observed to creep along the column of scrubber granules. The transparent canister 18 makes it possible to monitor the progress of this color change and permit change of the material 60 when required, thus eliminating the possibility that it is used for too long and begins to fail to remove all of the carbon dioxide. At the same time, monitoring the progress of color change of material 60 through the transparent canister 18 avoids waste of scrubber material 60 due to the tendency to change before it became necessary.

Since the subject immediately begins to emanate nitrogen or other gases when the unit is placed into use, these exhaled products begin at once to dilute oxygen in the system. Therefore, it is necessary periodically to purge the system to remove fluids exhaled by the subject and assure that the subject continues to breathe substantially pure oxygen. Purging can be quickly, simply and economically done by sequentially opening valves 2 and 10. Since the flow of oxygen in the system tends to be approximately laminar, the purge will require only a very small amount of oxygen. Furthermore, after approximately thirty minutes, most of the exhaled products have been eliminated from the subject's body. The purges then can be reduced to about once each hour.

If the subject is not able to breathe spontaneously it is possible to provide intermittent positive pressure breathing assistance. This can be accomplished because of the snug, non-leaking connection element 7, and breathing bag 13. It only is necessary to squeeze the breathing bag at an appropriate rate. When the bag is squeezed, it will raise the pressure throughout the entire system, forcing oxygen into the lungs via inhalation hose 9 and valve 6. Upon releasing the bag, the lungs of the subject tend to collapse due to their natural elasticity, driving the oxygen back into the mask 7 and from there to bag 13 via the exhalation valve 5, hose 4 and canister 18.

The foregoing disclosure and description of the invention are illustrative and explanatory thereof, and various changes in the size, shape and materials, as well as in the details of the illustrated construction may be mae without departing from the spirit of the invention.

I claim:

1. A closed circuit breating apparatus adapted for connectionto an oxygen supply for providing oxygen to a subject for breathing, the subject introducing carbon dioxide and other fluids into the apparatus while breathing, said appaatus comprising:

a conection element having a first end and a second end adapted to be secured to the subject in fluid communication with the respiratory system of the subject;

a non-return valve comprising;

a housing in closed circuit fluid communication with said first end of said connection element;

a one-way inhalation valve means for allowing oxygen to enter said housing when the subject inhales;

a one-way exhalation valve means for allowing oxygen and other exhaled fluids to exit said housing when the subject exhales;

an inhalation conduit in closed circuit fluid communication with said housing and connected to said housing adjacent said inhalation valve means to transport oxygen to said housing for the subject to inhale;

an exhalation conduit in closed circuit fluid communication with said housing and connected to said housing adjacent said exhalation valve means to transport oxygen and other exhaled fluids from said housing with the subject exhales;

carbon dioxide absorption means in closed circuit fluid communication between said inhalation and exhalation conduits for absorbing carbon dioxide exhaled by the subject;

means for connecting said carbon dioxide absorption means to receive fluids from said exhalation conduit and furnish purified fluids to said inhalation conduit;

an expansible breathing bag connected through said inhalation conduit in flow communication with said housing of said non-return valve assembly;

supply means including inlet tubing means mounted in said exhalation conduit for selectively introducing oxygen from the oxygen supply to a point adjacent said exhalation valve means for passage to said inhalation conduit through said carbon dioxide absorption means; and purge means including outlet tubing means mounted in said inhalation conduit and extending in said inhalation conduit to a point adjacent said inhalation valve means for purging fluids from the apparatus.

2. The apparatus of claim 1, wherein said supply means further includes:

inlet valve means disposed on said inlet tubing means; and said purge means further includes:

outlet purge valve means disposed on said outlet tubing means

3. The apparatus of claim 1, wherein said carbon dioxide absorption means further includes:

a canister in fluid communication with said means for connecting, comprising:

a tubular body having an inlet and an outlet;

an inlet cap connected to said inlet of said tubular body having an inlet port in closed circuit flow communication with said exhalation conduit through said means for connecting;

and outlet cap connected to said outlet of said tubular body having an outlet port in closed circuit flow communication with said inhalation conduit through said means for connecting;

a stationary perforated disk mounted in one end of said tubular body;

a movable perforated disk mounted in said tubular body at the opposite end of said tubular body from said stationary perforated disk; and a charge of carbon dioxide absorbing material disposed between said stationary perforated disk and said movable perforated disk.

4. The apparatus of claim 3, wherein said canister further includes:

biasing means connected to said movable disk to maintain said charge of absorbiing material in a packed condition.

5. The apparatus of claim 4, wherein said canister further includes:

at least one removably mounted baffle disposed in said tubular body between said stationary perforated disc and said movable perforated disc.

6. The apparatus of claim 5, wherein:

said baffle is in contact along its outer periphery with the inner wall of said tubular body and extends into said body, to redirect fluid flow along the inner wall of said body into said carbon dioxide absorbing material.

7. The apparatus of claim 6, wherein:

said baffle has an annular shape.

8. The apparatus of claim 7, wherein:

said biasing means comprises at least one coil spring connected between said movable perforated disc and said outlet cap;

said outlet cap is removably mounted to said tubular body.

9. The apparatus of claim 8, further including:

at least one spring loaded clamp means for securing said outlet cap sealably against said tubular body.

10. The apparatus of claim 3, wherein said tubular body further contains:

observation means for permitting monitoring of color changes of said carbon dioxide absorbing material while the subject is connected to the device thereby revealing the ability of said carbon dioxide absorbing material to absorb further carbon dioxide.

11. The apparatus of claim 3 wherein:

said tubular body is constructed from a transparent material.

12. The apparatus of claim 3, wherein said means for connecting includes:

a T-connector connected at a first port to the end of said inhalation conduit opposite from said inhalation valve means, said T-connector also being connected at a second port to

13. The apparatus of claim 1 wherein:

said means for connecting includes:

a connecting elbow connecting said exhalation conduit and said carbon dioxide absorption means; and wherein: said inlet tubing means is mountd extending through said connecting elbow to allow the oxygen source to be connected thereto.

* * * * *